US007559294B2

(12) United States Patent
Harth, III

(10) Patent No.: US 7,559,294 B2
(45) Date of Patent: Jul. 14, 2009

(54) END SUPPORT CONFIGURATION FOR STEAM TUBES OF A SUPERHEATER OR REHEATER

(75) Inventor: George H. Harth, III, Wadsworth, OH (US)

(73) Assignee: Babcock & Wilcox Power Generation Group Inc., Barberton, OH (US)

( * ) Notice: Subject to any disclaimer, the term of this patent is extended or adjusted under 35 U.S.C. 154(b) by 250 days.

(21) Appl. No.: 11/740,340

(22) Filed: Apr. 26, 2007

(65) Prior Publication Data

US 2008/0264358 A1 Oct. 30, 2008

(51) Int. Cl.
*F22B 17/02* (2006.01)

(52) U.S. Cl. ..... 122/511; 122/235.15

(58) Field of Classification Search ..... 122/235.15, 122/235.21, 360, 493, 495, 496, 510, 511; 165/134.1; 110/325
See application file for complete search history.

(56) References Cited

U.S. PATENT DOCUMENTS 4,444,157 A * 4/1984 Worley ..... 122/510
4,688,628 A * 8/1987 Moldenhauer ..... 165/67
5,042,452 A * 8/1991 Dubreuil et al. ..... 126/91 A
5,755,188 A * 5/1998 Phelps ..... 122/511
2002/0108614 A1* 8/2002 Schultz ..... 128/207.14
2007/0151525 A1* 7/2007 Kimura et al. ..... 122/235.15
2007/0175413 A1* 8/2007 Becker et al. ..... 122/493

* cited by examiner

*Primary Examiner*—Gregory A Wilson
(74) *Attorney, Agent, or Firm*—Michael J. Seymour; Eric Marich

(57) ABSTRACT

End support for parallel tubes of a superheater or reheater with a bend tubular portion, a linear tubular portion extending away from each end of the bend tubular portion, and a supporting member formed on a curved section of the bend tubular portion. The tubular portions form a connection between two consecutive parts of a fluid passage. In a preferred embodiment, the tubular portions and the supporting member are integrally formed, molded or cast of a suitable material, such as carbon steel, stainless steel, chromium-nickel alloy, or other suitable alloys that have high temperature strength and oxidation resistance. The supporting member is configured to securely attach the end support configuration to the wall support brackets on the wall support tube. Preferably, the supporting member and the wall support bracket slide on one another to provide relative movement between the superheater tubes and the wall support or boiler tubes.

14 Claims, 2 Drawing Sheets

END SUPPORT CONFIGURATION FOR STEAM TUBES OF A SUPERHEATER OR REHEATER

FIELD AND BACKGROUND OF INVENTION

The present invention relates generally to the end support section of the superheater or reheater tubes, which includes a bend area and a supporting member. The bend area and the supporting member are integrally formed, molded or cast of suitable material, such as the material used to construct the tubes.

Superheaters and reheaters can be broadly described as single-phase heat exchangers with steam flowing inside the tubes and flue gas passing outside, generally in crossflow. These devices are used to increase the temperature of saturated steam, thereby increasing its thermal energy. Thus, superheaters and reheaters are located in zones of high gas temperature. Due to their high operating temperature, it is preferable to transfer the major support loads of these devices to the steam tubes themselves.

Boiler manufacturers have used stainless steel attachments welded to the ends of superheater tubes as supports. These attachment welds add a high stress to the bend area of the tubing and this often causes failure of the bend or weld in service. Failure causes the steam tubes to lose support and can cause tube leaks that lead to unwanted boiler forced outages. In addition, welding tube support attachments is extremely labor intensive, and the attachments generally do not remain on the tubes for a long period of time. It is difficult, if not impossible, to perform maintenance on or to repair the tube support attachments in the boiler because they are not easily accessible. Furthermore, welds may have to be heat treated for some alloys. Also, the tube support attachments cannot withstand high temperatures, i.e., above 1400 degrees fahrenheit, unless cooling is used. As a result, welded support attachments are expensive to install, operate and maintain, and lack the durability needed to support steam tubes that are subjected to elevated temperatures.

Accordingly, a need remains for an end support capable of overcoming one or more of the above-mentioned disadvantages. The end support of the present invention is integrally formed, molded or cast as a single body from suitable material, such as steel alloy. The end support of the present invention is also more economical to install and more durable than the prior art.

Additional details relating to superheater or reheater design can be found in Chapters 1, 7 and 19 of *Steam/its generation and use,* 41$^{th}$ Edition, Stultz and Kitto, Eds., Copyright ©2005, The Babcock and Wilcox Company, the text of which is hereby incorporated by reference as though fully set forth herein.

SUMMARY OF INVENTION

It is an object of the present invention to provide an end support configuration for parallel steam tubes of a superheater or reheater. The end support configuration is integrally formed as a single component, and comprises a bend tubular portion, a first linear tubular portion extending from one end of the bend tubular portion, a second linear tubular portion extending from the other end of the bend tubular portion, and a supporting member formed substantially on the bend tubular portion. The tubular portions form a connection between two consecutive parts of a fluid passage, and the supporting member is configured for attaching the end support configuration to the wall support of the boiler.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENTS

Figure 1:
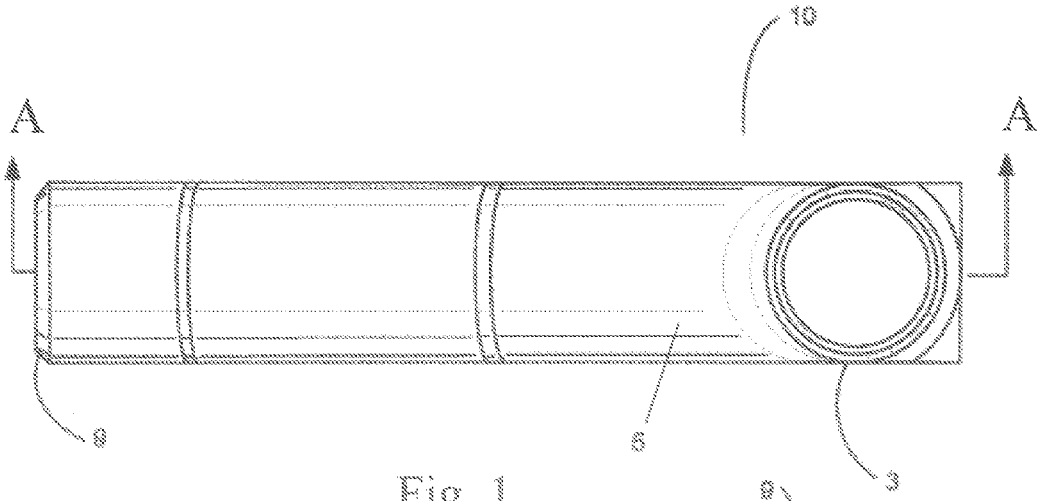
FIG. 1 is a top view of the end support configuration of the present invention.
Figure 2:
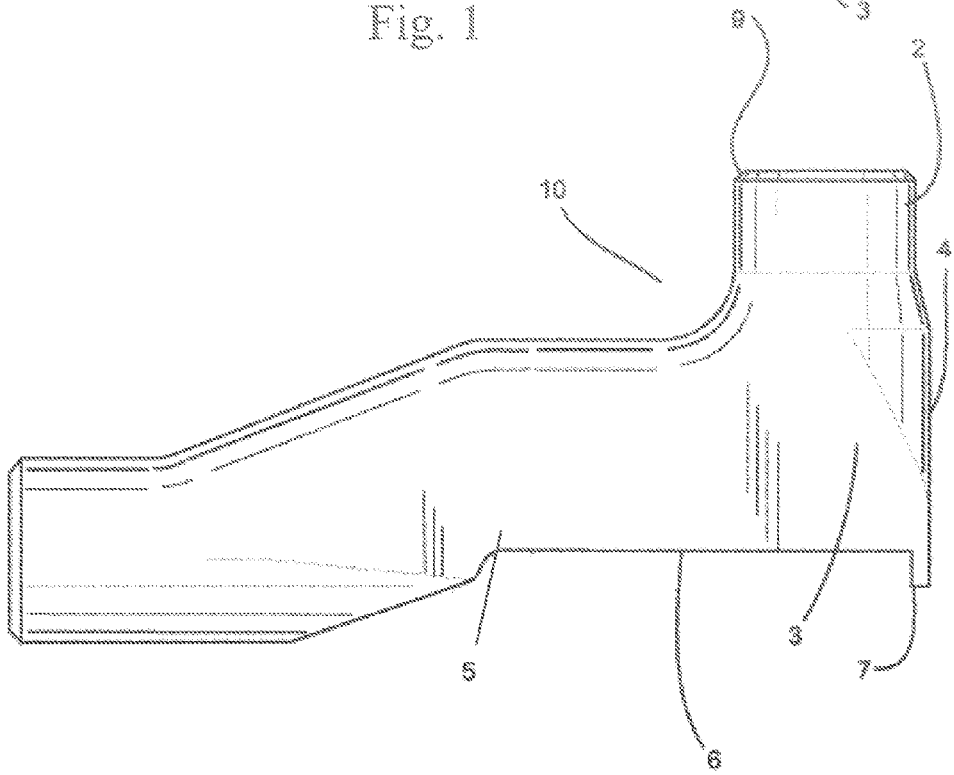
FIG. 2 is side view of the end support configuration as shown in FIG. 1.
Figure 3:
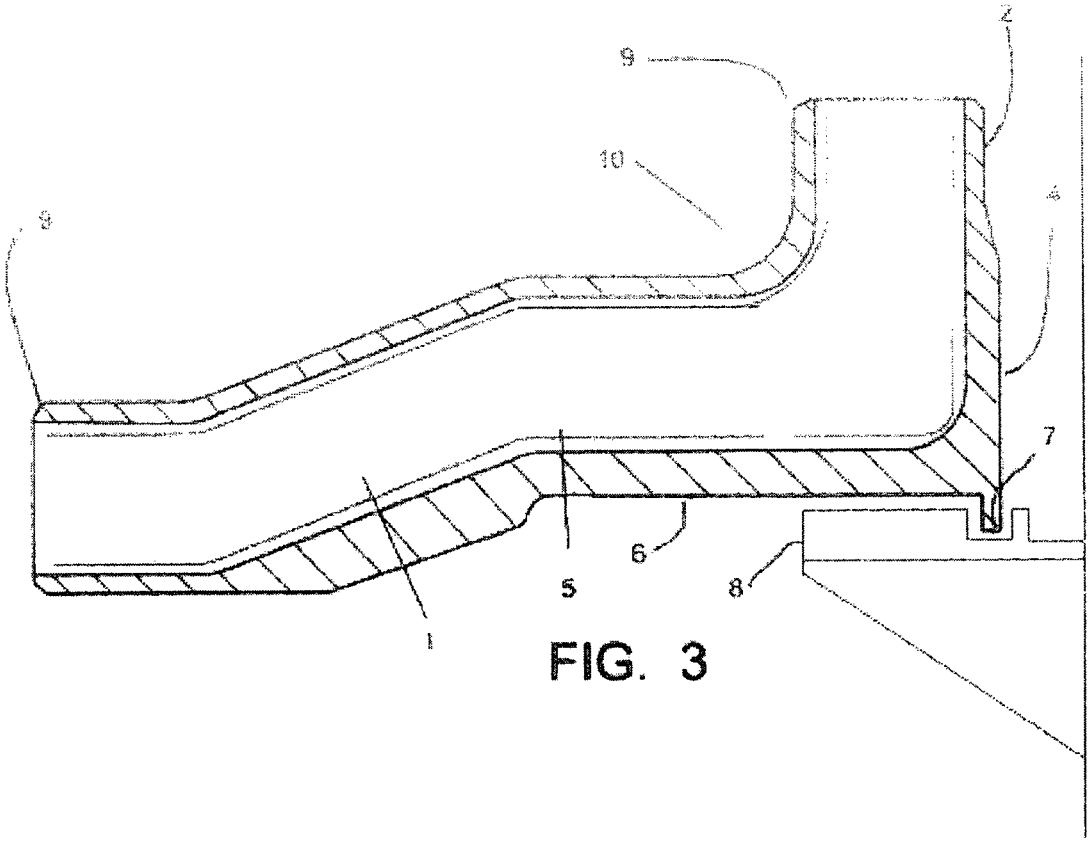
FIG. 3 is a cross-sectional view of the end support configuration as shown in FIG. 1, along lines A-A.

Referring now to the drawings, in which like reference numerals are used to refer to the same or similar elements, FIG. 1 shows an end support configuration 10 for supporting parallel steam tubes of a superheater or reheater. The end support configuration 10 comprises a bend tubular portion 3, a linear tubular portion (2, 5) extending from each end of the bend tubular portion 3, and a supporting member 8 formed substantially on the bend tubular portion 3. The ends of the linear tubular portions (2, 5) may be joined to two steam tubes of the superheater or reheater, preferably, to form a connection between two consecutive parts of a fluid passage. The linear tubular portions (2, 5) may or may not have the same length. Linear tube portion 5 may also comprise a second bend 1 along the length of the linear tube portion 5.

The linear tubular portions (2, 5) may be joined to the steam tubes by welding or other suitable joining technique now known or subsequently developed. In one embodiment, the ends of the linear tubular portions (2, 5) are tapered or slightly tapered 9 to provide a better fit or joint between the linear tubular portions (2, 5) and the steam tubes. In another embodiment, the bend tubular portion 3 is in the form of an arc. Preferably, the bend tubular portion 3 forms an arc of about 90 degrees. In an alternative embodiment, the arc has a constant radius of less than 90 degrees.

The end support configuration 10 is integrally formed as a single component from carbon steel, stainless steel, steel alloy, or other suitable material that has high temperature strength and oxidation resistance. The end support configuration 10 may be formed of one or more suitable metals or alloys (now known or subsequently discovered) that have high temperature strength and oxidation resistance. The end support configuration 10 may be formed of the same material used to construct the steam tubes. Forming the end support configuration as an integral or unitary structure permits the steam passing through the inside of the steam tubes to cool the supporting member. In one embodiment, the end support configuration 10 is formed such that it is capable of withstanding temperatures of over 1400 degrees C.

The supporting member 8 is also configured for securing the end support configuration 10 to the wall support of the boiler. In one embodiment, the supporting portion comprises a base 6 that is substantially parallel to a portion of the longitudinal axes of the linear tubular portion 5, (preferably prior to alternative embodiment second tube bend 1), a side wall 4 that is substantially perpendicular to the longitudinal axes of the linear tubular portion 2, and a bend that extends along a curved section of the bend tubular portion 3.

In another embodiment, the base 6 comprises at least one protrusion 7 for mating with at least one corresponding recess (not shown) provided on the wall support. In another embodiment, the supporting member 8 is moveably attached to the wall support. Preferably, supporting member 8 and the wall support slide on one another to provide relative movement between the steam tubes and the wall support/boiler tubes.

It is contemplated that the tubular portions (1, 2, 3, 5) may have uniform circular cross section. The width of the base 6 and side wall 4 of the supporting member 8 preferably, although not necessary, correspond to the diameter of the tubular portions (1, 2,3, 5).

While a specific embodiment of the invention has been shown and described in detail to illustrate the application of the principles of the invention, it will be understood that the invention may be embodied otherwise without departing from such principles.

I claim:

1. An end support configuration for parallel steam tubes of a superheater or reheater, comprising:

a bend tubular portion;

a first linear tubular portion extending from one end of the bend tubular portion;

a second linear tubular portion extending from the other end of the bend tubular portion; and a supporting member formed substantially on the bend tubular portion, wherein the tubular portions form a connection between two consecutive parts of a fluid passage;

the supporting member is configured for attaching the end support configuration to a wall support; wherein the end support comprises a base part that is substantially parallel to a longitudinal axes of the linear tubular portions, a side part that is substantially perpendicular to the longitudinal axes of the linear tubular portions, and the width of the base and side part of the supporting member is equal to the diameter of the tubular portions; and the tubular portions and the supporting member are integrally formed as a single component or body.

2. The end support configuration of claim 1, wherein the configuration is integrally molded or cast of a suitable material.

3. The end support configuration of claim 1, wherein the configuration is capable of withstanding temperatures of over 1400 degrees fahrenheit.

4. The end support configuration of claim 1, wherein steam flowing through the tubular portions cools the supporting member.

5. The end support configuration of claim 1, wherein the configuration is integrally formed, molded or cast of stainless steel or a suitable alloy.

6. The end support configuration of claim 5, wherein the alloy has high temperature strength and oxidation resistance.

7. The end support configuration of claim 1, wherein the linear tubular portions comprise a tapered end for facilitating connection or welding to respective steam tubes of the superheater or reheater.

8. The end support configuration of claim 1, wherein the linear tubular portions do not have the same length.

9. The end support configuration of claim 8, wherein the supporting member is formed about an area having a longer linear tubular portion.

10. The end support configuration of claim 1, wherein the base part of the supporting member comprises at least one protrusion for mating with at least one corresponding recess provided on the wall support.

11. The end support configuration of claim 10, wherein the configuration is movably attached to the wall support.

12. The end support configuration of claim 1, wherein the supporting member and the wall support slide on one another to provide relative movement between the steam tubes and the wall support.

13. The end support configuration of claim 1, wherein the tubular portions have a uniform circular cross section.

14. The end support configuration of claim 1, wherein the configuration is configured for supporting the steam tubes of the superheater or reheater.

* * * * *